US007744027B2

(12) United States Patent
Nagao

(10) Patent No.: US 7,744,027 B2
(45) Date of Patent: Jun. 29, 2010

(54) PLANETARY BALL MILL

(75) Inventor: Fumiyoshi Nagao, Kawasaki (JP)

(73) Assignee: Nagao System Inc., Kanagawa-ken (JP)

( * ) Notice: Subject to any disclaimer, the term of this patent is extended or adjusted under 35 U.S.C. 154(b) by 323 days.

(21) Appl. No.: 11/675,526

(22) Filed: Feb. 15, 2007

(65) Prior Publication Data

US 2008/0197223 A1 Aug. 21, 2008

(51) Int. Cl.
*B02C 17/08* (2006.01)

(52) U.S. Cl. ..... 241/170; 241/175

(58) Field of Classification Search ..... 241/170, 241/175, 70, 65

See application file for complete search history.

(56) References Cited

U.S. PATENT DOCUMENTS 858,495 A * 7/1907 Bailey ..... 241/46.08
1,194,717 A * 8/1916 Cover ..... 241/69
2,208,077 A * 7/1940 Linke ..... 241/84.1
2,315,229 A * 3/1943 Schieferstein ..... 241/175
3,060,058 A * 10/1962 Wilkie et al. ..... 427/177
3,944,145 A * 3/1976 Eichholz et al. ..... 241/23
4,250,015 A * 2/1981 Yang et al. ..... 208/419
5,707,861 A * 1/1998 Sherman et al. ..... 435/306.1
6,126,097 A * 10/2000 Chen et al. ..... 241/27

FOREIGN PATENT DOCUMENTS

JP 04-222650 8/1992
JP 08-243371 9/1996
JP 08-332367 12/1996
JP 09-220459 8/1997
JP 2000-176268 6/2000

* cited by examiner

*Primary Examiner*—Faye Francis
(74) *Attorney, Agent, or Firm*—Sughrue Mion, PLLC

(57) ABSTRACT

A planetary ball mill includes: a revolution turning arm turned about a revolution shaft rotated by a driving force; mill pots each supported on the revolution turning arm so as to be rotated about a rotation shaft inclined from the vertical direction toward the side of the revolution shaft; and an outer circumferential pot receiver which is disposed fixedly on the upper side of the revolution turning arm along the whole part of a circumference around the revolution shaft and with which the outer peripheral surfaces of the mill pots revolving attendantly on the turning of the revolution turning arm make contact, whereby the mill pots are put into rotation.

5 Claims, 7 Drawing Sheets

PLANETARY BALL MILL

BACKGROUND OF THE INVENTION

1. Field of the Invention

The present invention relates to a planetary ball mill for grinding a matter to be ground, by bringing a mill pot containing grinding medium balls and the matter to be ground into rotation concurrently with revolution.

2. Description of the Related Art

There has been known a planetary ball mill such that revolutional centrifugal forces and rotational centrifugal forces generated in a mill pot (grinding vessel) in rotation during its planetary motion inclusive of rotation and revolution are applied to the matter to be ground and grinding medium balls contained in the mill pot, to cause severe collisions between the matter to be ground and the grinding medium balls, and the matter to be ground is grounded by the resulting compression and shearing.

FIG. 6 shows a general structure of a planetary ball mill described in Japanese Patent No. 2904399, for example. The planetary ball mill 200 has a structure in which the driving force of a motor 201 is transmitted through a transmission chain 202 to a main shaft (revolution turning shaft) 203, mill pots 206 are mounted through rotation shafts 207 on the upper and lower sides to the tips of upper and lower revolution turning arms 204 and 205 extending in the radial direction from the main shaft 203 so that the mill pots 206 can be turned, and a sun sprocket 209 fixed non-turnably on the same axis as the axis of the main shaft 203 and planetary sprockets 210 fixed on rotation shafts 207 are connected by transmission chains 211. With the motor 201 rotated, each of the mill pots 206 is put into rotation by the turning of the rotation shaft 207 while revolving around the main shaft 203.

The planetary ball mill is characterized by an extremely excellent grinding speed owing to the synergistic effect of a high revolutional centrifugal acceleration and a high rotational centrifugal acceleration.

SUMMARY OF THE INVENTION

However, the planetary ball mills in the related art have had the following problems. First of all, the planetary ball mill as shown in FIG. 6 uses the sprockets and the transmission chain as the mechanism for putting the mill pot into rotation and, therefore, the equipment would be large in size or scale. Accordingly, there has been a demand for reductions in the size and price of the planetary ball mill characterized by its extremely high grinding speed so that the planetary ball mill can be used also for experiments.

In addition, as shown in FIG. 6, the conventional planetary ball mill has a structure in which the rotation shaft 207 is disposed vertically and, hence, in parallel to the revolution shaft (main shaft) 203. Where the rotational axis is set vertical, as shown in FIG. 7, in the beginning period of dry grinding in the mill pot 206, grinding does progress because the coarse matter to be or being ground and the grinding medium balls B collide against each other while being fluidized. As the grinding progresses and the particle diameter of the matter being ground is reduced, however, deposition begins to occur from the place where the revolutional centrifugal force is strong (a bottom side surface) in the order of increasing particle diameter, i.e., in the order of fine particles, tiny particles, somewhat coarse particles, and the grinding medium balls B. Therefore, the grinding medium balls B come gradually to perform only a compressing motion by rolling only on the surface of the deposit, resulting in that the grinding by the fluidized motions ceases. Accordingly, particulates cannot be obtained even when the grinding (milling) time is prolonged, so that the planetary ball mill is unsuitable for obtaining particulates and is poor in grinding efficiency.

The present invention has been made in consideration of the above situations. Accordingly, it is an object of the present invention to provide a planetary ball mill which can be reduced in size and price and which is excellent in grinding efficiency.

In order to attain the above object, according to the present invention, there is provided a planetary ball mill including a revolution turning arm turning about a revolution shaft rotated by a driving force, a mill pot turnably supported on the revolution turning arm through a rotation shaft inclined from the vertical direction toward the side of the revolution shaft, and an outer circumferential pot receiver which is fixedly disposed on the upper side of the revolution turning arm over the whole part of a circumference around the revolution shaft and with which an outer peripheral surface of the mill pot revolving attendantly on the turning of the revolution turning arm makes contact, whereby the mill pot is put into rotation.

The planetary ball mill according to the present invention has a structure in which the mill pot being rotatable and being in revolution makes, under a centrifugal force thereof, contact with the outer circumferential pot receiver so as to be thereby put into a rotating motion. Therefore, there is no need for a large-type transmission gear for putting the mill pot into a rotational motion. Moreover, since the outer circumferential pot receiver bears the centrifugal force in this structure, the bearing for the rotation shaft for the mill pot can also be simplified, permitting reductions in size and cost.

Besides, since the rotation shaft of the mill pot is inclined and the rotating speed of the mill pot put into rotation by the contact between the outer circumferential pot receiver and the mill pot can be set higher than the revolving speed, the grinding medium balls and the matter to be ground in the mill pot are put into fluidization with a tornado motion of climbing up, while spinning at high speed, along the inside surface of the mill pot inclined toward the axis of revolution. As a result, grinding with good fluidity is attained, promising an extremely favorable grinding efficiency.

In the planetary ball mill as above, preferably, the inside bottom of the mill pot has a concaved spherical shape.

Where the inside bottom of the mill pot in the planetary ball mill has a concaved spherical shape, it is ensured that the fluidization with the tornado motion of climbing up, while spinning at high speed, along the inside surface of the mill pot inclined toward the axis of revolution will take place more easily, whereby the grinding efficiency can be enhanced.

In addition, in the planetary ball mill as above, preferably, an inside side wall of the mill pot is provided with a recess.

With the inside side wall of the mill pot provided with the recess, the forces of the grinding medium balls can be concentrated into the recess, so that the grinding efficiency can be enhanced.

Besides, in the planetary ball mill as above, preferably, the part, with which the mill pot makes contact, of the outer circumferential pot receiver has a shape deviated from a locus of revolution around the revolution shaft, and the rotation shaft is supported on the revolution turning arm so as to be swingable relative to the radial direction of a circle centered at the revolution shaft.

This structure ensures that the mill pot is put by a centrifugal force into an oscillating motion while being constantly kept in contact with the outer circumferential pot receiver which has a shape deviated from a locus of revolution. As a result, grinding with good fluidity is attained due to the oscillating motion added to the tornado motion, whereby an extremely high grinding efficiency is promised.

In addition, in the planetary ball mill as above, preferably, an outer peripheral surface, making contact with the outer circumferential pot receiver, of the mill pot has a shape deviated from a circular shape centered at the rotation shaft, and the rotation shaft is supported on the revolution turning arm so as to be swingable relative to the radial direction of a circle centered at the revolution shaft.

Where the mill pot having an outer peripheral surface of a shape deviated from a circular shape is used, the mill pot is put into an oscillating motion by the contact there of with the outer circumferential pot receiver. Therefore, the oscillating motion is added to the tornado motion, so that grinding with good fluidity is achieved, which leads to an extremely high grinding efficiency.

Besides, in the planetary ball mill as above, preferably, the angle of inclination of the rotation shaft from the vertical direction is in the range of 15 to 40 degrees.

Where the angle of inclination of the rotation shaft from the vertical direction is set in the range of 15 to 40 degrees, the tornado motion can be generated effectively.

The planetary ball mill according to the present invention can be reduced in size and price, and is excellent in grinding efficiency.

BRIEF DESCRIPTION OF THE DRAWINGS

FIG. 5A is a schematic configuration view of a planetary ball mill provided with a swing mechanism, FIG. 5B-1 is a schematic diagram showing the case where the outer circumferential pot receiver has a shape conforming to an elliptic orbit, and FIG. 5B-2 is a schematic diagram showing the case where the outer peripheral surface of the mill pot is elliptic in shape;

DETAILED DESCRIPTION OF THE PREFERRED EMBODIMENTS

Now, an embodiment of the planetary ball mill according to the present invention will be described below, but the invention is not to be limited to the following embodiment.

Figure 1:
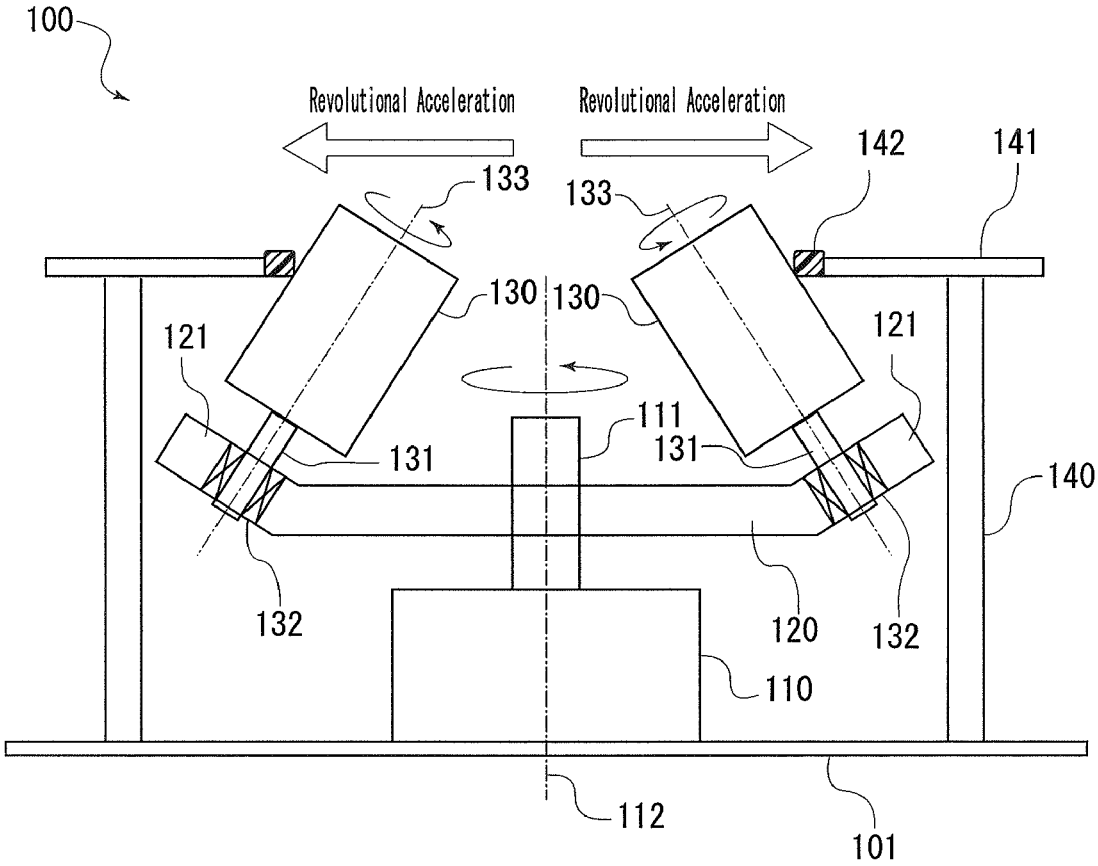
FIG. 1 is a schematic configuration diagram showing an embodiment of the planetary ball mill according to the present invention.

FIG. 1 is a schematic configuration diagram showing an embodiment of the planetary ball mill according to the present invention. The planetary ball mill 100 has a configuration in which an electric motor 110 as a drive source is disposed on a base 101, and the rotating shaft 111 of the electric motor 110 is projecting vertically upwards. The rotating shaft 111 functions as a revolution shaft which rotates about an axis of revolution 112 coinciding with the axis of itself. A substantially central part of a revolution turning arm 120 extending horizontally in the radial direction from the axis of revolution 112 is fixed to the rotating shaft 111. Both tip portions of the revolution turning arm 120 are each formed as an inclined support part 121 bent to the upper side from a horizontal direction at a predetermined inclination angle. On each inclined support part 121, a rotation shaft 131 fixed to a mill pot 130 is turnably (rotatably) supported through a bearing 132. The mill pot 130 has a bottomed hollow cylindrical shape hermetically sealed with a cap (not shown), and the rotation shaft 131 coaxial with the mill pot 130 is fixed to the center of the outside bottom surface of the mill pot 130. The axis of turning (rotation) 133 of the rotation shaft 131 is inclined at a predetermined inclination angle from the vertical direction toward the side of the axis of revolution 112 so as to intersect the axis of revolution 112 on the upper side of the mill pot 130. The mill pot 130 is rotatably supported on the revolution turning arm 120 through the rotation shaft 131 inclined from the vertical to the side of the axis of revolution 112.

At an outer peripheral portion of the base 101, a hollow cylindrical peripheral wall 140 along an orbit of revolution is provided so as to surround the electric motor 110. A ring-shaped support plate 141 is fixed to the upper end edge of the peripheral wall 140, and the inner circumferential edge of the support plate 141 has a circular shape substantially coinciding with the orbit of revolution. An outer circumferential pot receiver 142 composed of a ring-shaped elastic blank material is attached to the inner circumferential edge of the support plate 141. The outer circumferential pot receiver 142 is disposed fixedly on the upper side of the revolution turning arm 120, over the whole part of the circumference of a circle centered at the revolution shaft (rotating shaft) 111. The inner circumferential edge of the outer circumferential pot receiver 142 is disposed at a position which is located on an orbit of revolution where the outer peripheral surfaces of the mill pots 130 revolving attendant on the turning of the revolution turning arm 120 make contact with the inner circumferential edge and which is minutely spaced from the outer peripheral surfaces of the mill pots 130 being at rest. Examples of the elastic material which can be used to form the outer circumferential pot receiver 142 include synthetic rubbers such as silicone rubbers, urethane rubber, etc. and natural rubber.

Now, operations of the planetary ball mill 100 as above will be described. With the electric motor 110 driven, the rotating shaft 111 of the electric motor 110 rotates, as shown in FIG. 1, and the revolution turning arm 120 is turned attendant on the rotation of the rotating shaft 111. Attendant on the turning of the revolution turning arm 120, the mill pots 130 revolves around the axis of revolution 112. By the revolution of the mill pots 130, a revolutional acceleration directed in the radial direction from the axis of revolution 112 is generated in each mill pot 130, whereby each mill pot 130 is raised in the centrifugal direction toward the vertical direction by an amount corresponding to the backlush of the bearing 132 by the revolutional centrifugal force, to make contact with the outer circumferential pot receiver 142. Due to the contact of the revolving mill pots 130 with the outer circumferential pot receiver 142, the friction between the outer peripheral surfaces of the mill pots 130 and the outer circumferential pot receiver 142 causes each of the mill pots 130 to rotate about the axis of rotation 133 of the rotation shaft 131.

In this manner, each of the mill pots 130 is put into the rotating motion about the axis of rotation 133 inclined from the vertical direction, while revolving around the axis of revolution 112; thus, each mill pot 130 performs a planetary motion. In the planetary ball mill 100 according to the present invention, the rotational speed is determined by the ratio of the diameter of the inner circumferential edge, making contact with the mill pots 130, of the outer circumferential pot receiver 142 and the diameter of the outer periphery, making contact with the outer circumferential pot receiver 142, of each mill pot 130. Since the diameter of the inner circumferential edge of the outer circumferential pot receiver 142 is several times as large as the diameter of the outer periphery of each mill pot 130, there is a characteristic feature that the rotational speed is several times as high as the revolutional speed. The ratio of rotational speed to revolutional speed is, for example, from about 2 to about 8. In the planetary ball mills in the related art, for example, the revolutional speed is 2000 rpm, and the rotational speed is 60 rpm; thus, the rotational speed has been by far lower than the revolutional speed.

Figure 2:
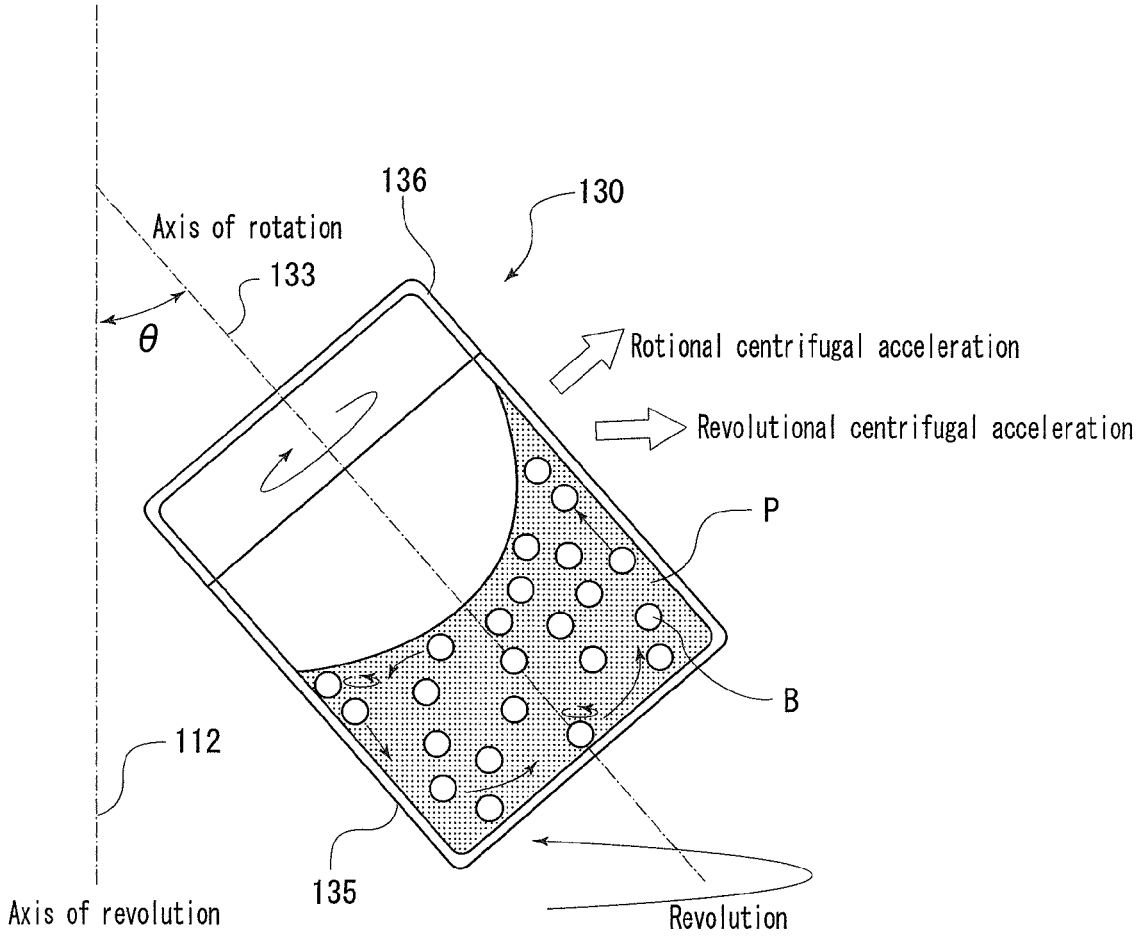
FIG. 2 is a conceptual diagram illustrating the grinding mechanism of the planetary ball mill according to the present invention.

FIG. 2 is a conceptual diagram illustrating the mechanism of grinding by the above-described planetary motion. The mill pot 130 has a structure in which the top opening of the bottomed hollow cylindrical pot body 135 is hermetically sealed with the cap 136. The planetary ball mill 100 according to the present invention is characterized in that the axis of rotation 131 of the mill pot 130 is inclined at an inclination angle θ from the vertical direction and that the rotational speed is several times as high as the revolutional speed. In carrying out the grinding, grinding medium balls B and the matter to be ground P are sealed in the mill pot 130.

With the mill pot 130 put into the revolving motion, the matter to be ground P and the grinding medium balls B in the mill pot 130 are strongly pressed against the inside bottom surface and the inside side surface of the mill pot 130 by the revolutional centrifugal acceleration. When the rotational centrifugal acceleration at the rotational speed several times as high as the revolutional speed is additionally exerted, at the inclination angle θ of the rotation shaft 131 of the mill pot 130, the grinding medium balls B and the matter to be ground P climb up, while spinning at high speed, along the inside surface of the mill pot 130 inclined toward the axis of revolution 112, so that they collide against each other while being in the tornado motion. The tornado motion causes a continuous convection motion of the matter to be ground P and the grinding medium balls B. The matter to be ground P is subjected to shearing, grinding, disintegration and dispersion, under the collision with and high compression by the grinding medium balls B, whereby it is converted into a fine powder. Such a grinding mechanism promises grinding with good fluidity and an enhanced grinding efficiency, as compared with a planetary ball mill not having the inclination angle θ.

In addition, the presence of the inclination angle θ ensures that the matter to be ground P and the grinding medium balls B in the mill pot 130 are pressed to the side of the inside bottom surface of the pot body 135, so that they would not rise up to the position of the cap 136. Therefore, the ground powder P would not easily leak through the position of the cap 136.

The inclination angle θ of the axis of rotation 133 from the vertical direction is not particularly limited. It has been empirically confirmed, however, the inclination angle is preferably in the range of 15 to 40 degrees, particularly in the range of 20 to 35 degrees, from the viewpoint of easy occurrence of the tornado motion. It is recognized that it is difficult for the tornado motion to take place when the inclination angle is 45 degrees, though the reason has not yet been elucidated.

In the planetary ball mill 100 according to the present invention, a rotation mechanism is adopted in which the revolving mill pots 130 are pressed against the fixed outer circumferential pot receiver 142 by the revolutional centrifugal force. Since a transmission mechanism such as sprockets and transmission chain is not used in the rotation mechanism, the mechanism is simplified, promising reductions in size and cost. Moreover, a structure is adopted in which the revolutional centrifugal forces of the mill pots 130 are received by the outer circumferential pot receiver 142, so that the revolutional centrifugal forces acting on the mill pots 130 are exerted dispersedly on the bearings 132 and on the outer circumferential pot receiver 142. Therefore, the load on the bearings is lighter, and the mechanism inclusive of the bearings can be simplified, which contributes on reductions in size and cost. Besides, the number of movable parts is small, which is advantageous from the viewpoint of maintenance. The reduced size makes it possible to dispose the planetary ball mill 100 in a thermostat or a freezer, for example; thus, the planetary ball mill 100 can cope with a wide variety of matters to be ground.

As for the operating conditions of the planetary ball mill 100 according to the present invention, for example, the inside volume of the mill pot may be in the range of 100 to 200 ml, the revolutional speed may be 100 to 2000 rpm, and the rotational speed may be 200 to 5000 rpm. In the case where the revolutional speed is 666 rpm, the radius of revolving motion is 126 mm, the rotational speed is 2000 rpm (hence, the ratio of rotational speed to revolutional speed is 3.0), and the rotating vessel inside diameter is 42 mm, the grinding can be performed at a revolutional acceleration of 62 G, a rotational acceleration of 188 G, and a composite acceleration of 250 G.

Examples of use of the planetary ball mill 100 according to the present invention include both dry grinding and wet grinding in pulverization of electronic blank materials, ceramics, metals, etc., cutting of fibers in organism specimens such as soft tissue, etc., extraction pretreatment of soil bacteria DNA, emulsification and dispersion in food, cosmetic and medical fields, production of polymeric toners, etc.

The planetary ball mill 100 according to the present invention can assume various forms, for enhancing the grinding efficiency. For example, a mill pot 130*b* shown in FIG. 3A has a form in which the inside bottom of a pot body 135*b* has a concaved spherical shape. Where the inside bottom surface of the mill pot 130*b* is spherically shaped, it is easier to achieve the tornado motion in which the grinding medium balls B and the matter to be ground P climb up, while spinning at high speed attendant on the high-speed rotation, along the inside surface of the mill pot 130*b* inclined toward the axis of revolution 112, as compared with the case of a flat inside bottom surface. The spherical concavity of the inside bottom surface is preferably a maximum spherical surface with a diameter equal to the inside diameter of the mill pot 130*b*.

Figure 3:
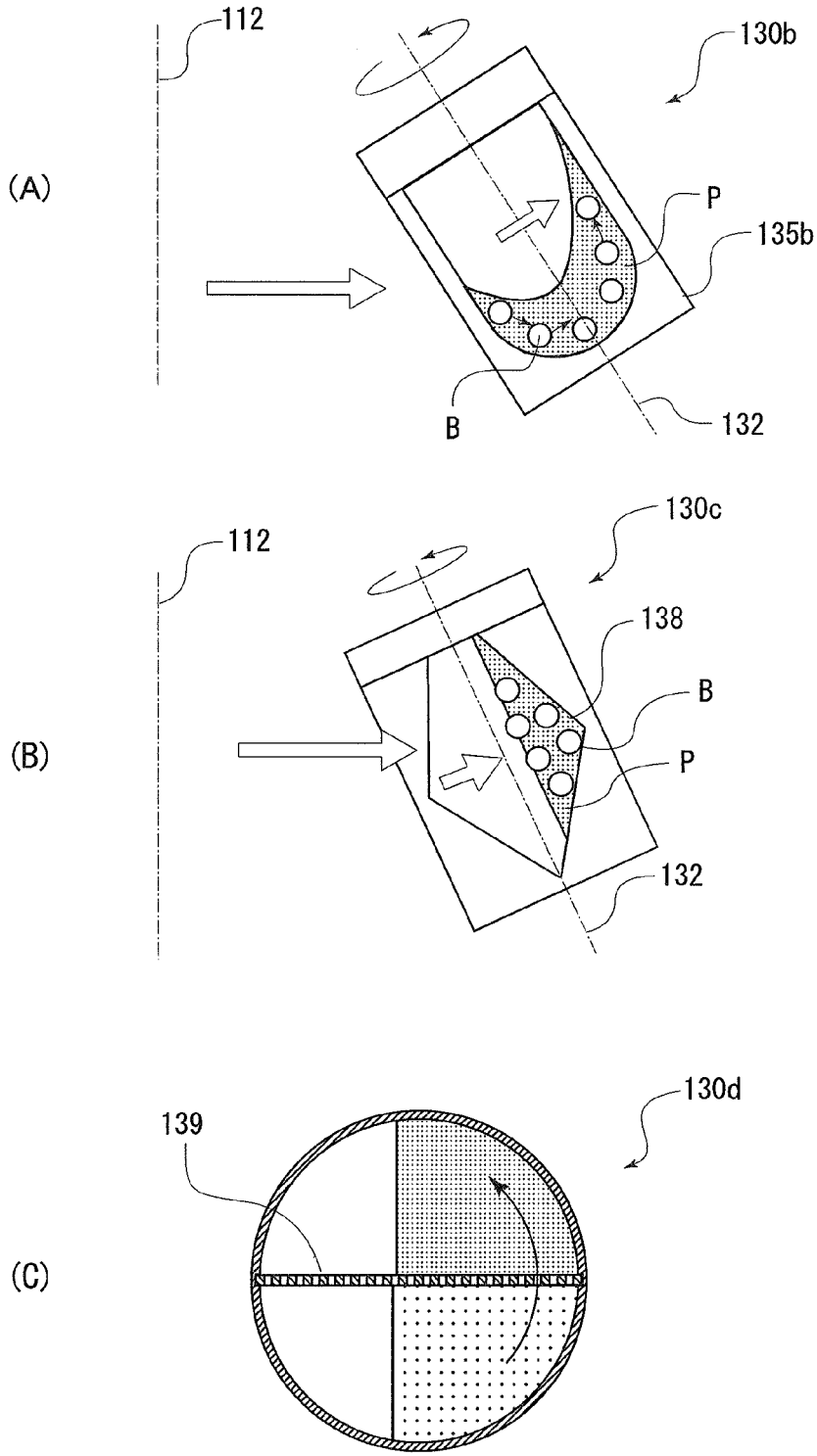
FIG. 3A is a conceptual diagram showing schematically the inside of a mill pot having an inside bottom in a spherical shape.
FIG. 3B is a conceptual diagram showing schematically the inside of a mill pot having an inside wall provided with a recess.
FIG. 3C shows schematically a cross-sectional structure of a mill pot incorporating a perforated plate.

In addition, a mill pot 130*c* shown in FIG. 3B has a form in which the inside side wall is provided with a recess 138. Where the inside side wall of the mill pot 130*c* is provided with the recess 138, the forces of the grinding medium balls B can be concentrated into the recess 138, so that the grinding efficiency can be enhanced. As shown in FIG. 3B, the shape of the recess 138 may be a shape of a bead on an abacus having an inclined surface the inside diameter of which gradually increases as one approaches the central maximum inside diameter from the upper and lower sides. The shape of a bead of an abacus may be provided in plurality in one mill pot 130*c*.

Besides, a mill pot 130*d* shown in FIG. 3C has a structure in which, in place of the grinding medium balls, a perforated plate 139 such as a punching metal and a mesh provided with a multiplicity of fine holes permitting a powder to pass there-through is fixed on the inside wall of the mill pot 130*d* substantially in the diameter direction and along the axial direction, whereby the inside of the mill pot 130*d* is bisected in the axial direction by the perforated plate 139. In the planetary ball mill 100 of the present invention in which high-speed rotation is utilized, the rotational speed of the perforated plate 139 in high-speed rotation is by far higher than the medium liquid and the powder largely delayed under the revolutional centrifugal force and the rotational centrifugal force, so that the powder is forced to pass through the perforated plate 139. This process is repeated at a rate of not less than 5000 times/min, whereby not only pulverization of a solid matter but also dispersion or emulsification of a solid matter can be accelerated. The perforate plate 139 is selected to have a sufficient strength for enduring the flow velocities and grinding.

The grinding by the grinding medium balls B generates a considerable quantity of heat; therefore, a powder weak to heat may be deteriorated by the rise in temperature. In addition, there are matters to be ground which must be ground at low temperatures. On the contrary, grinding under heating may be required in some cases. Therefore, it may be necessary in some cases to cool or heat the mill pots 130 in the planetary ball mill 100 according to the present invention.

Figure 4:
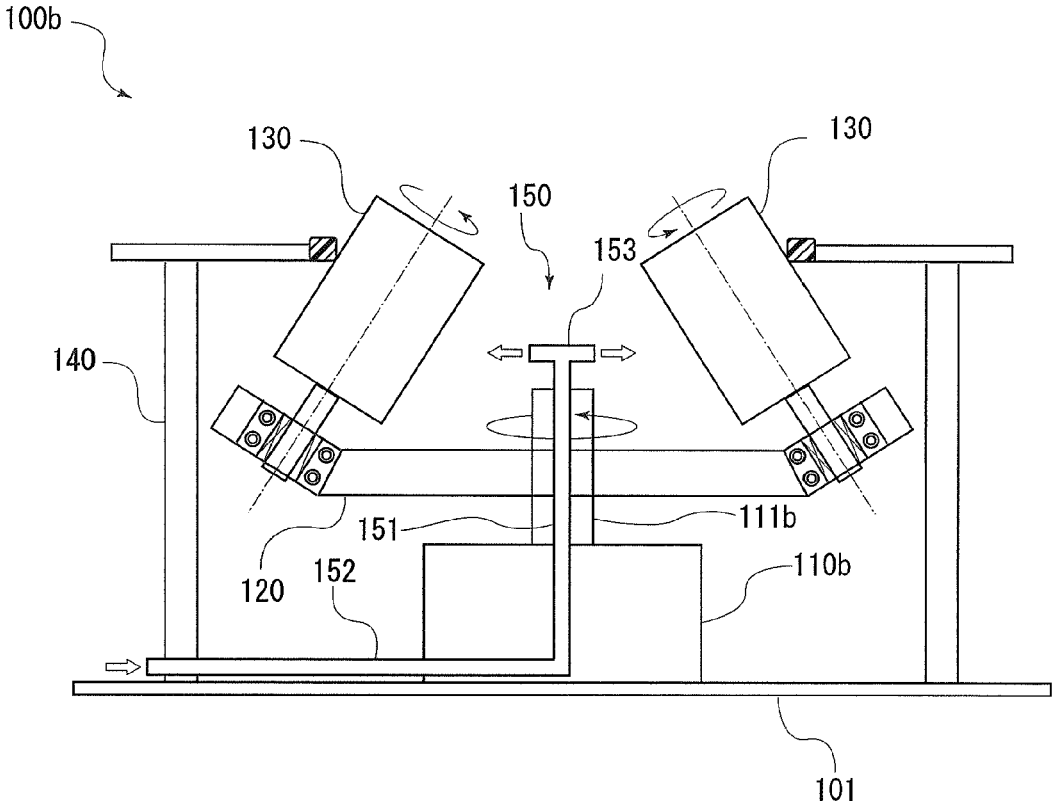
FIG. 4 is a schematic configuration diagram of a planetary ball mill provided with a thermostatic device.

FIG. 4 is a schematic configuration diagram showing an embodiment of the planetary ball mill 100*b* provided with a thermostatic device by which the mill pots can be cooled or heated. The thermostatic device 150 has a structure in which a hollow shaft is adopted as the rotating shaft 111*b* of an electric motor 110*b*, a pipe 152 for guiding a cooled or heated gas from the exterior is connected to the hollow portion 151 of the rotating shaft 111*b*, and, further, the hollow rotating shaft 111*b* is provided with blow-off ports 153 for blowing the gas from the rotating shaft 111*b* toward the mill pots 130. With the hollow rotating shaft 111*b* thus utilized as a guide pipe for blowing, the blow-off ports 153 provided in the hollow rotating shaft 111*b* are turned together with the mill pots 130, so that the gas can constantly be blown off toward the mill pots 130. Besides, the cooled or heated gas can be blown to the mill pots 130 through a minimum distance. In the case of a high degree of cooling, a gas having passed through a guide pipe cooled by use of liquid nitrogen as a cooling medium can be used.

Figure 5:
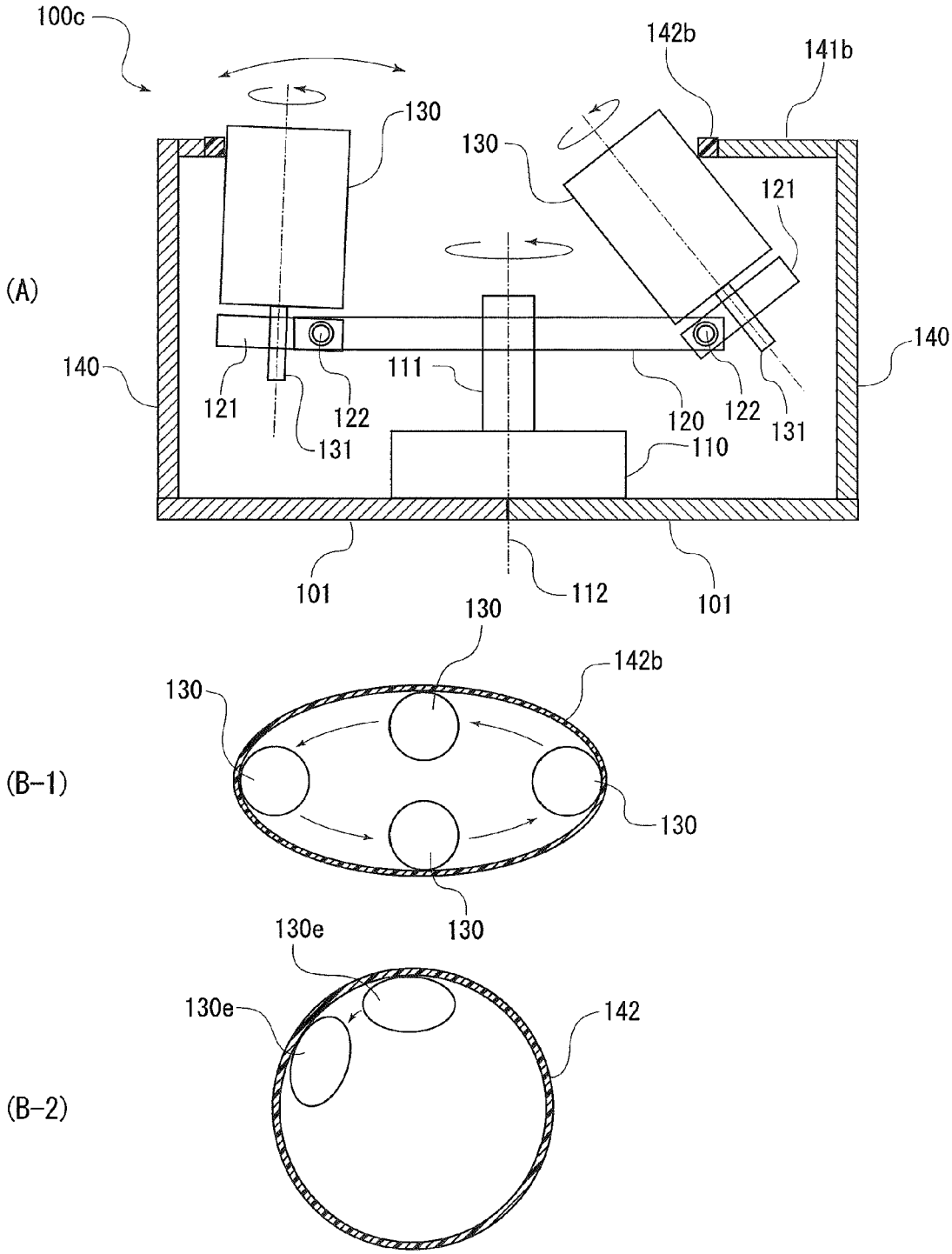

FIG. 5 is a schematic configuration diagram showing an embodiment of the planetary ball mill 100*c* provided with a swing mechanism for imparting an oscillating motion to the mill pot 130 by varying the inclination angle θ of rotation during revolution. The left side and the right side of FIG. 5A are sections intersecting each other at an angle of 90 degrees. Even in the planetary ball mill according to the present invention, there is a possibility of the phenomenon in which the grinding proceeds through the collision between the coarse matter to be ground and the grinding medium balls under fluidization in the beginning stage of dry grinding, but as the grinding progresses and the diameter of the particles being ground becomes smaller, deposition starts from the place where the revolutional centrifugal force is strong (the side surface of the bottom portion) in the order of fine particles, minute particles, somewhat coarse particles and the balls, so that the balls come gradually to perform only the compressing motion by rolling only on the surface of the deposit, the grinding by the fluidization ceases, and the particles being ground are not further reduced in diameter. For preventing such a deposition and improving the fluidity so as to enhance the grinding efficiency, it is effective to provide the mill pot with the swing mechanism and thereby to impart angle variations to the powder and the grinding medium balls.

Figure 6:
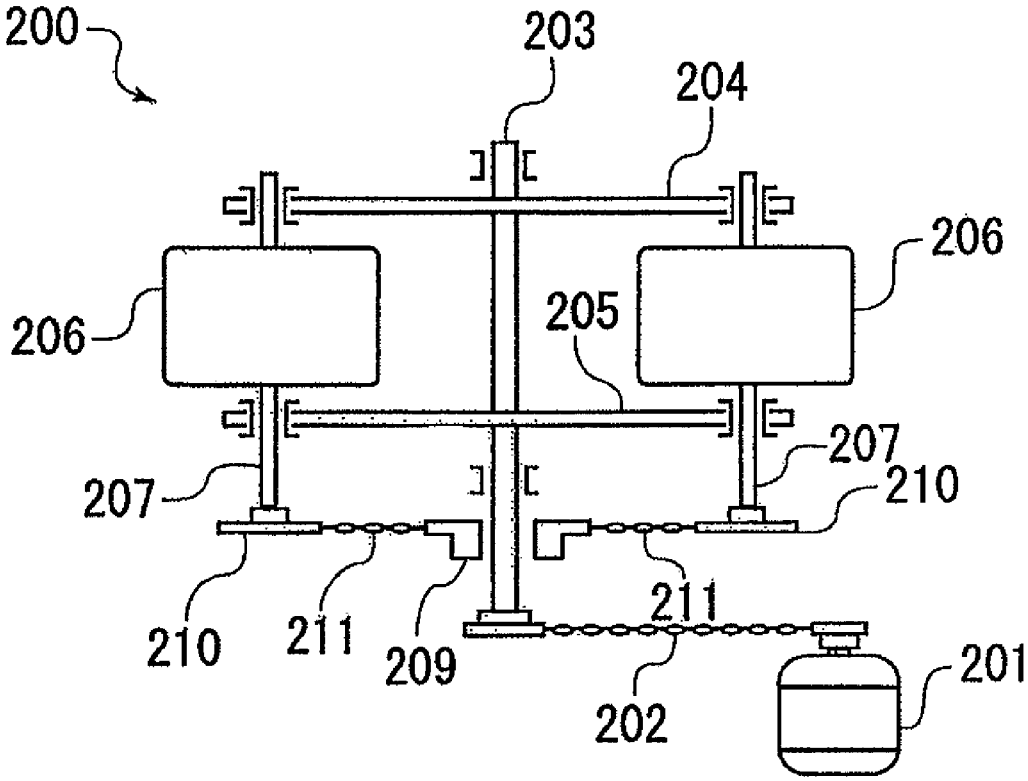
FIG. 6 (RELATED ART)
FIG. 6 is a schematic configuration diagram of a planetary ball mill according to the related art.
Figure 7:
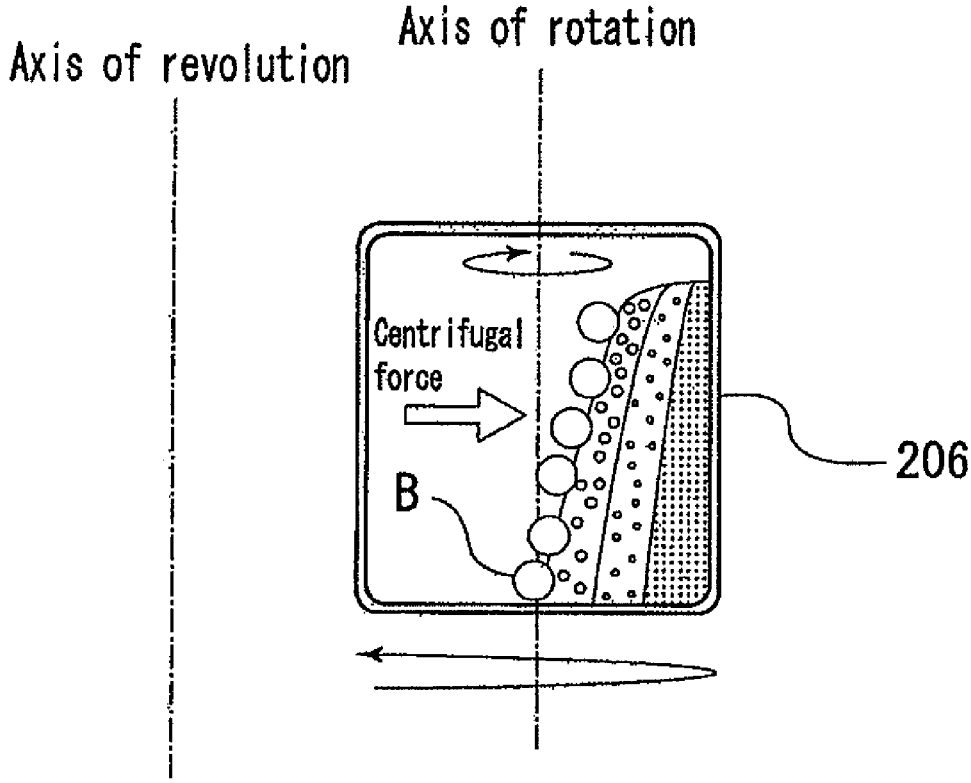
FIG. 7 (RELATED ART)
FIG. 7 is a schematic diagram showing the problem in grinding by the planetary ball mill in the related art.

The planetary ball mill 100*c* shown in FIG. 5A has a structure in which inclined support parts 121 for rotatably supporting the rotation shafts 131 are each connected to the revolution turning arm 120 through a hinge 122 so as to be swingable relative to the radial direction of a circle centered at the axis of revolution 112. In addition, the inner circumferential edge, with which the mill pots 130 make contact, of the outer circumferential pot receiver 142*b* fixed to the inner circumferential edge of the support plate 141*b* having an inner circumferential edge shape deviated from an orbit of revolution has a track shape deviated from the orbit of revolution. Each of the mill pots 130 in revolution is swung along the track of the inner circumferential edge of the outer circumferential pot receiver 142*b*, with the hinge 122 as a center of swinging, by the revolutional centrifugal force. As for track shape of the outer circumferential pot receiver 142*b*, the outer circumferential pot receiver 142*b* may have an elliptic track as shown in FIG. 5B-1, for example. The difference between the maximum diameter and the minimum diameter of the elliptic track is the swinging (oscillation) angle. For example, in the case of an elliptic track in which the inclination angle θ at the location of the minimum elliptic diameter shown on the right side of FIG. 6A is 45 degrees and the inclination angle θ at the location of the maximum elliptic diameter shown on the left side of FIG. 5A is 10 degrees, swinging with the inclination angle θ continuously varied in the range of 45 to 10 degrees is performed. The ratio between the rotational speed and the revolutional speed is determined by the ratio between the length of the inner circumferencial edge of the outer circumferential pot receiver 142*b* and the length of the circular circumference of the mill pot 130. In the elliptic track of the outer circumferential pot receiver 142*b* as shown in FIG. 5B-1, swinging occurs twice in one revolution.

Besides, a swing mechanism in which the outer peripheral surface of each mill pot 130*e* is elliptically shaped, as shown in FIG. 5B-2 may also be adopted. In this case, the shape of the outer circumferential pot receiver may be a circular track as shown in FIG. 5B-2 or may be an elliptic track as shown in FIG. 5B-1. In the case where the mill pot 130*e* having the outer peripheral surface in an elliptical shape is used, the number of times of swinging in one revolution is equal to the number of times of rotation. On the other hand, in the case of the outer circumferential pot receiver 142*b* with an elliptic track, the swing inclination angle is determined by the minimum inside diameter and the maximum inside diameter of the elliptic track and the minimum outside diameter and the maximum outside diameter of the elliptic outer periphery of the mill pot 130*e*.

While the number of the mill pots is two, and the mill pots are disposed at both ends of the revolution turning arm in the diameter direction, in the above description, the number of mill pots may be three or more, insofar as the mill pots are disposed at positions on equally spaced radial directions from the axis of revolution.

Besides, an anti-slip band composed of an elastic blank material may be provided on the outer peripheral surface of the mill pot.

The planetary ball mill according to the present invention can be reduced in size and price and can pulverize at high speed a variety of matters to be ground, and, therefore, it can be utilized for development of mechanochemical or other novel functional materials.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A planetary ball mill comprising:

a revolution turning arm turning about a revolution shaft rotated by a driving force;

a mill pot turnably supported on said revolution turning arm through a rotation shaft inclined at an inclination angle from the vertical direction toward the side of said revolution shaft;

an outer circumferential pot receiver which is fixedly disposed on the upper side of said revolution turning arm over the whole part of a circumference around said revolution shaft and with which an outer peripheral surface of said mill pot revolving attendantly on the turning of said revolution turning arm makes contact, whereby said mill pot is put into rotation; and a plurality of grinding medium balls.

wherein an inside bottom of said mill pot has a concave spherical shape, a rotational speed of the mill pot is higher than a revolutional speed of the revolution turning arm, and a revolutional centrifugal force of the revolution turning arm and a rotational centrifugal force of the mill pot inclined at the inclination angle cause; the grinding medium balls and matter to be ground in the mill pot to climb upward, while spinning at high speed, along the inside surface of the mill pot inclined at the inclination angle.

2. The planetary ball mill as set forth in claim 1, wherein an inside side wall of said mill pot is provided with a recess.

3. The planetary ball mill as set forth in claim 1, wherein the part of said outer circumferential pot receiver, with which said mill pot makes contact, has a non-circular shape which deviates from a locus of revolution around said revolution shaft, and said rotation shaft is swingably supported on said revolution turning arm so as to swing in the radial direction of a circle centered on said revolution shaft.

4. The planetary ball mill as set forth in claim 1, wherein an outer peripheral surface of said mill pot, which makes contact with said outer circumferential pot receiver, has a non-circular shape centered on said rotation shaft, and said rotation shaft is swingably supported on said revolution turning arm so as to swing in the radial direction of a circle centered on said revolution shaft.

5. The planetary ball mill as set forth in claim 1, wherein the angle of inclination of said rotation shaft from the vertical direction is in the range of 15 to 40 degrees.

* * * * *